United States Patent [19]

Eickenhorst

[11] 4,416,640

[45] Nov. 22, 1983

[54] LIFE RING

[75] Inventor: Jay P. Eickenhorst, Stinson Beach, Calif.

[73] Assignee: Dennis J. Romano, San Francisco, Calif. ; a part interest

[21] Appl. No.: 244,269

[22] Filed: Mar. 16, 1981

[51] Int. Cl.[3] ..... B63C 9/08

[52] U.S. Cl. ..... 441/81

[58] Field of Search ..... 9/9, 14, 311, 312, 313, 9/340, 1; 114/190, 254; 242/85.1; 102/504; 428/100; 441/81, 84, 85

[56] References Cited

U.S. PATENT DOCUMENTS

| | | | |
|---|---|---|---|
| 2,342,868 | 2/1944 | King | 9/340 |
| 3,027,115 | 3/1962 | Allen | 242/85.1 |
| 3,372,411 | 3/1968 | Robertson | 9/340 |
| 3,378,865 | 4/1968 | Pigg | 9/14 |
| 4,288,556 | 10/1980 | Searls | 9/14 |

*Primary Examiner*—Trygve M. Blix
*Assistant Examiner*—Jesus D. Sotelo
*Attorney, Agent, or Firm*—Owen, Wickersham & Erickson

[57] ABSTRACT

An improved life ring has a ring buoy with a rope connected at its one end to the buoy. Releasable retaining devices at several locations around one side of the buoy hold the rope in coiled fashion on the buoy but release to free the coil, without snagging, when the buoy is thrown into the water.

3 Claims, 5 Drawing Figures

LIFE RING

This invention relates to aquatic life saving apparatus, particularly to an improved life ring.

BACKGROUND OF THE INVENTION

There are three methods for effecting the resuce of a swimmer in distress: swimming to the victim and effecting an in-water rescue, extension of a rescue device to the victim from the shore or vessel, and approaching the victim in a craft by water or air. The present invention relates to the second type of rescue, namely rescues effected from land or a vessel by extending a rescue device to the swimmer. Such devices include long poles, ropes, and floatation devices such as ring buoys, torpedo buoys (which are also used for inwater rescue), and other floating objects such as a surfboard. It is desired to keep contact with such a floatation device so that it may be retrieved for re-throwing, or to pull the swimmer in once the floatation device has been caught. This is typically done by attaching a rope to the floatation device.

It is very important that water safety resuce devices be readily available and always prepared for immediate use. This requires that they be located in close proximity to the water and than any preparations needed before use be taken care of well in advance of any contemplated use. For this reason, when a throwable floatation device such as a life ring is installed at a waterfront or on a boat, the rope attached to it will typically be neatly coiled and left adjacent to the buoy, either by hanging the coil up or laying it down next to the buoy.

A standard life ring includes a ring buoy (a doughnut shaped floatation device) with a rope connected to it. A float is often tied to the free-end of the rope, so that it is easily retrievable when accidently dropped into the water. The life ring is typically used by holding the free end of the rope at a point near its end between the float and the buoy, under the foot of the rescuer, or by otherwise securing it to a point on shore. The buoy is held loosely in the hand of the throwing arm of the rescuer and the coil of rope is held loosely in the other hand, with the coil side closest to the buoy facing out toward the water. The throwing arm is cocked several times in a wide arc as the rescuer's aim is set on the victim, then the throwing hand is opened at the peak of one of these arcs and the buoy is released on a trajectory toward the victim. As the buoy flies toward the victim, the successive coils of rope play out from the other hand of the rescuer. Once the victim has grabbed the buoy, the rescuer pulls the victim to safety by retrieving the rope.

A significant problem which has remained unsolved in the art is that the coil of rope tends to become tangled between and during uses. When the buoy is thrown, the tangled rope knots and jerks the buoy away from its flight path, usually causing it to fall short of the victim. The buoy must then be retrieved, the rope untangled and recoiled, and the throw attempted again. This is a very dangerous problem since time is essential in rescuing a distressed swimmer.

Various attempts have been made in the prior art to hold a ring buoy and its rope coil in a state of readiness. The U.S. Pat. No. to Barr (4,033,276) shows a support for life ring and associated retrieval line. This support is a bracket, mounted at a proper position on the shore or vessel having a pair of clamping members which apply pressure to opposite sides of a ring buoy, thus holding it up. The retrieval line is wound about the ends of the clamps. Although this earlier attempt does hold the rope and buoy ready for use, an added element of time is involved when removing the life ring and line from the holder. Also, the line may become tangled when carried or thrown, or could even be dropped. The Barr invention does not keep a life ring in a constant state of readiness.

SUMMARY OF THE INVENTION

It is an object of the present invention to provide releasable ropeholding means for readying a life ring for immediate use at all times.

Another object of the invention is to provide an improved life ring having a releasably attached coil of rope, the end of which is secured fast to the buoy, wherein release of the coil is effected upon throwing of the life ring.

These and other objects and advantages are accomplished in accordance with the principles of the present invention which will now be described.

An improved life ring constructed in accordance with the present invention comprises a standard ring buoy with several releasable holding members attached to one of the faces thereof. A rope is also connected to the ring buoy, and is coiled on the face having the releasable securing members. The releasable holding or securing members are closed over the coil of rope, holding it adjacent to the ring buoy. In one preferred embodiment four releasable attaching members are disposed evenly about the face of the buoy. The preferred material for the releasable securing members is Velcro.

Other objects, advantages, and features of the present invention will become apparent from the following detailed description of embodiments presented in conjunction with the accompanying drawing.

DETAILED DESCRIPTION OF THE PREFERRED EMBODIMENTS

Figure 1:
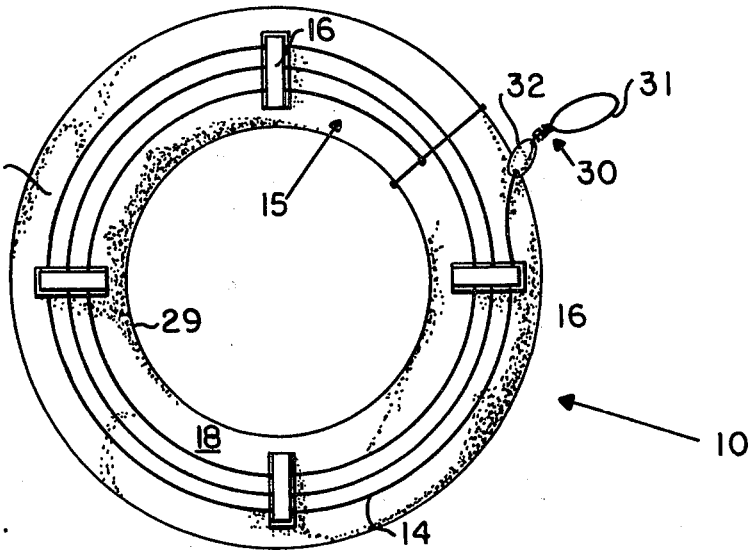
FIG. 1 is a bottom plan view of an improved life ring of the invention, showing the ring in a state of readiness to be thrown.

As illustrated in FIG. 1, the improved life ring 10 of the invention comprises a ring buoy 12 with a rope 14 formed in a coil 15 connected to it, and at least one, but preferably several releasable attaching members 16 disposed on the buoy. The releasable attaching members 16 may be located anywhere about the buoy 12 as long as the rope is held in a coil 15; for example on inner circular edge 17, but they are preferably attached on one of the faces 18 of the buoy. The releasable attaching members 16 are preferably radially disposed evenly about the circle which comprises the ring buoy 12. Although one releasable attaching member 16 would be sufficient to hold the rope 14 coiled adjacent to the ring buoy 12, it is preferred that several such members be used, optimally four.

Figure 2:
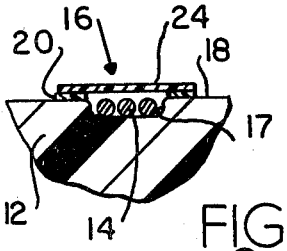
FIG. 2 is a sectional view of an embodiment of the improved life ring of the invention, having a recessed channel for holding a coil of rope.

The releasable attaching members 16 may be constructed of an easily breakable material adapted for only one use, but are preferably reusable. It is also possible to use C-shaped clamping members (not shown) into which the coil is pressed, but this is not desired since a protrusion from the ring buoy may cause injury to a victim to which it is thrown. A recessed channel 17 as illustrated in FIG. 2, may be provided in one of the faces 18 of the buoy for receiving a coil of rop 14. Releasable attaching members may extend across the top of the channel to hold the rope in place.

Figure 3:
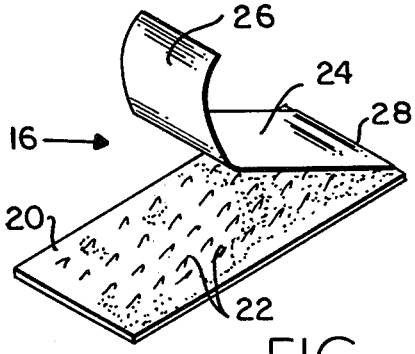
FIG. 3 is a top perspective view of a Velcro releasable attaching member of the invention, showing two corresponding strips of Velcro separated from each other and permanently attached together at one end.

The preferred material for the releasable attaching members 16 is Velcro. As illustrated in FIG. 3, the Velcro material comprises two pieces, a first strip 20 having small hooks 22 and a second strip 24 having a material surface 26 which releasably grabs the small hooks 22, The first strip 20 and the second strip 24 may be separate from each other, but, are preferably permanently attached together at one end 28 so that they do not come apart completely when the two strips separate upon throwing the life ring. The attached end 28 is perferably oriented closest to the inner circular edge 29 of the ring buoy 12.

The improved life ring 10 is prepared for use by pulling the second strip 24 of releasable attaching material away from the first strip 20 of each releasable attaching member 16. The rop 14 is then coiled around the face 8 of the ring buoy 12, so that the coil 15 lies on top of the exposed first strip 20 of each releasable attaching member 16. A small length of the free end 30 of the rope 14 is left uncoiled, for holding when the life is thrown. A float 32 is attached near the free end 30 of the rope 14 to hold it afloat in case it is accidentally dropped into the water. The free end 30 may also be tied into a loop 31 to assist in holding it. The second strip 24 is pulled over the coil 15 and pressed together with the first strip 20 of each releasable attaching member 16, thereby releasably securing the coil to the face 18 of the ring buoy 12.

Figure 4:
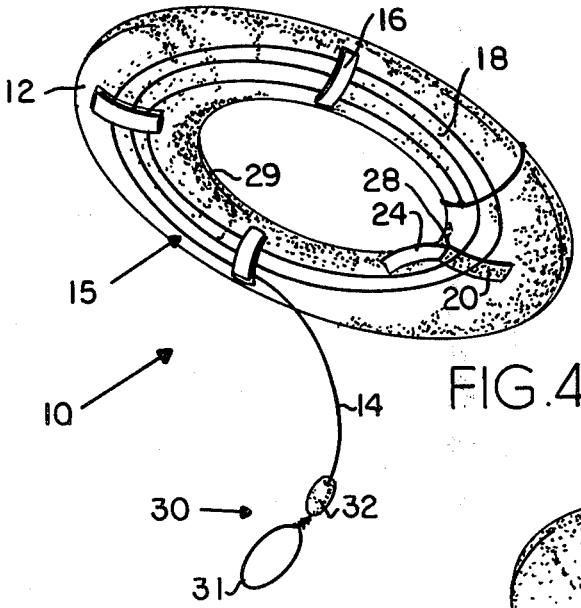
FIG. 4 is a bottom perspective view of the improved life ring of the invention, showing the life ring as it is being thrown, and illustrating the release of one of the attachment members.
Figure 5:
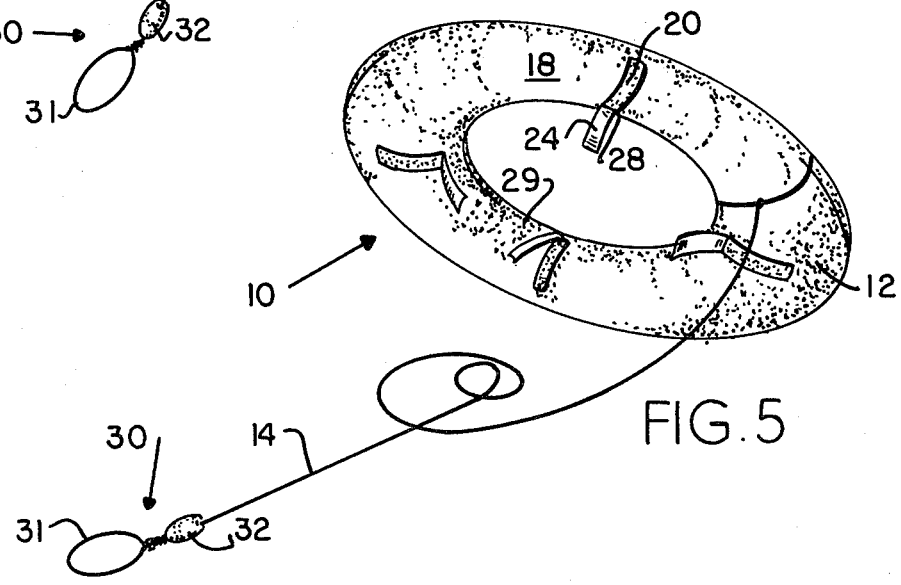
FIG. 5 is a view similar to FIG. 3, illustrating the improved life ring of the invention being thrown after the attachment members have released the coil or rope.

Coil release is illustrated in FIGS. 4 and 5. The improved life ring 10 is used by holding the inner circular edge 29 of the ring buoy 12 in the throwing hand of the rescuer and either holding the free end 30 or loop 31 of the rope 14 either in the other hand, or by stepping on the rope 14 between the float 32 and the ring buoy 12. /The face 18 of the buoy 12 with the coil 15 is held face down toward the water upon throwing for better release of the attaching members 16, and to further help keep the coil from tangling. Once the free end 30 of the rope 14 has been secured, the improved life ring is thrown by using a wide arcing motion of the throwing arm. When the buoy is released, the rope 14 becomes taught between the point where it is being held and the first releasable attaching member 16. As the momentum of the throw carries the life ring further on its trajectory, the pressure from the rope pulls the second strip 24 away from the first strip 20 of each of the releasable attaching members 16 sequentially, allowing the coil 15 to fall freely from the ring buoy 12 without interfering with its trajectory. The coil 15 will not tangle or become knotted because it is played out immediately upon being freed. Once the victim grabs hold of the ring buoy 12 the rope 14 may be pulled in, thereby pulling the victim to safety.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

I claim:

1. An improved life ring, comprising:

a generally doughnut-shaped ring buoy having a top surface, a bottom surface, a closed, generally convex edge wall that defines the circumferential exterior of the ring buoy, and an inner circular edge;

a rope connected at one end to said ring buoy and having a free end for holding when said ring buoy is thrown; and a series of releasable attachment means solely on one of said top and bottom surfaces of the ring buoy, spaced angularly apart on said one surface, for retaining the rope visibly exposed, coiled circumferentially along said one surface and for quickly and immediately releasing the entire coil of rope with little resistance to the travel of the ring buoy when it is thrown, in any orientation, with the rope's free end held, said releasable attachment means consisting of a series of strips disposed in generally radial configuration on said one surface and each having a component extending over the coil of rope with means for releasing the components in response to pressure from any direction of pull which the rope can exert when the ring buoy is thrown.

2. The improved life ring of claim 1, wherein the releasable attachment means comprise pairs of corresponding strips of Velcro material radially disposed on said one surface, a first strip of each pair permanently secured to the ring buoy, and said component being a second strip of each Velcro pair releasably retained to the first strip with the rope positioned between the strips.

3. The improved life ring of claim 1, further comprising a recessed channel disposed in said one surface for storing said coil of rope, said component of the releasable attachment means extending across the channel.

* * * * *